US006893522B1

(12) United States Patent
Crainic

(10) Patent No.: US 6,893,522 B1
(45) Date of Patent: May 17, 2005

(54) HIGH BULK NON-WOVEN COMPOSITE FABRIC

(75) Inventor: Sorin Crainic, Frankfurt am Main (DE)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 09/675,076

(22) Filed: Sep. 28, 2000

Related U.S. Application Data

(60) Provisional application No. 60/157,689, filed on Oct. 5, 1999.

(51) Int. Cl.[7] ..... B32B 31/26; D04H 1/00; D04H 1/48

(52) U.S. Cl. ..... 156/148; 156/181; 156/308.2; 28/103; 28/104

(58) Field of Search ..... 156/148, 181, 156/308.2; 28/103–104; 442/384, 408

(56) References Cited

U.S. PATENT DOCUMENTS 5,253,397 A * 10/1993 Neveu et al. ..... 28/105
5,375,306 A * 12/1994 Roussin-Moynier ..... 28/104
5,674,339 A * 10/1997 Groeger et al. ..... 156/145
5,874,159 A * 2/1999 Cruise et al. ..... 156/291

* cited by examiner

*Primary Examiner*—Sam Chuan Yao
(74) *Attorney, Agent, or Firm*—Wood, Phillips, Katz, Clark & Mortimer

(57) ABSTRACT

The method generally comprises the steps of providing a hydroentangled non-woven layer having a first binder component, and depositing a second non-woven layer having a high bulk and loft on to the hydroentangled layer to form an unbonded composite fabric. The second layer also has a binder component with a melting temperature substantially equal to the first binder melting temperature.

11 Claims, 1 Drawing Sheet

HIGH BULK NON-WOVEN COMPOSITE FABRIC

CROSS REFERENCE

Figure 1:
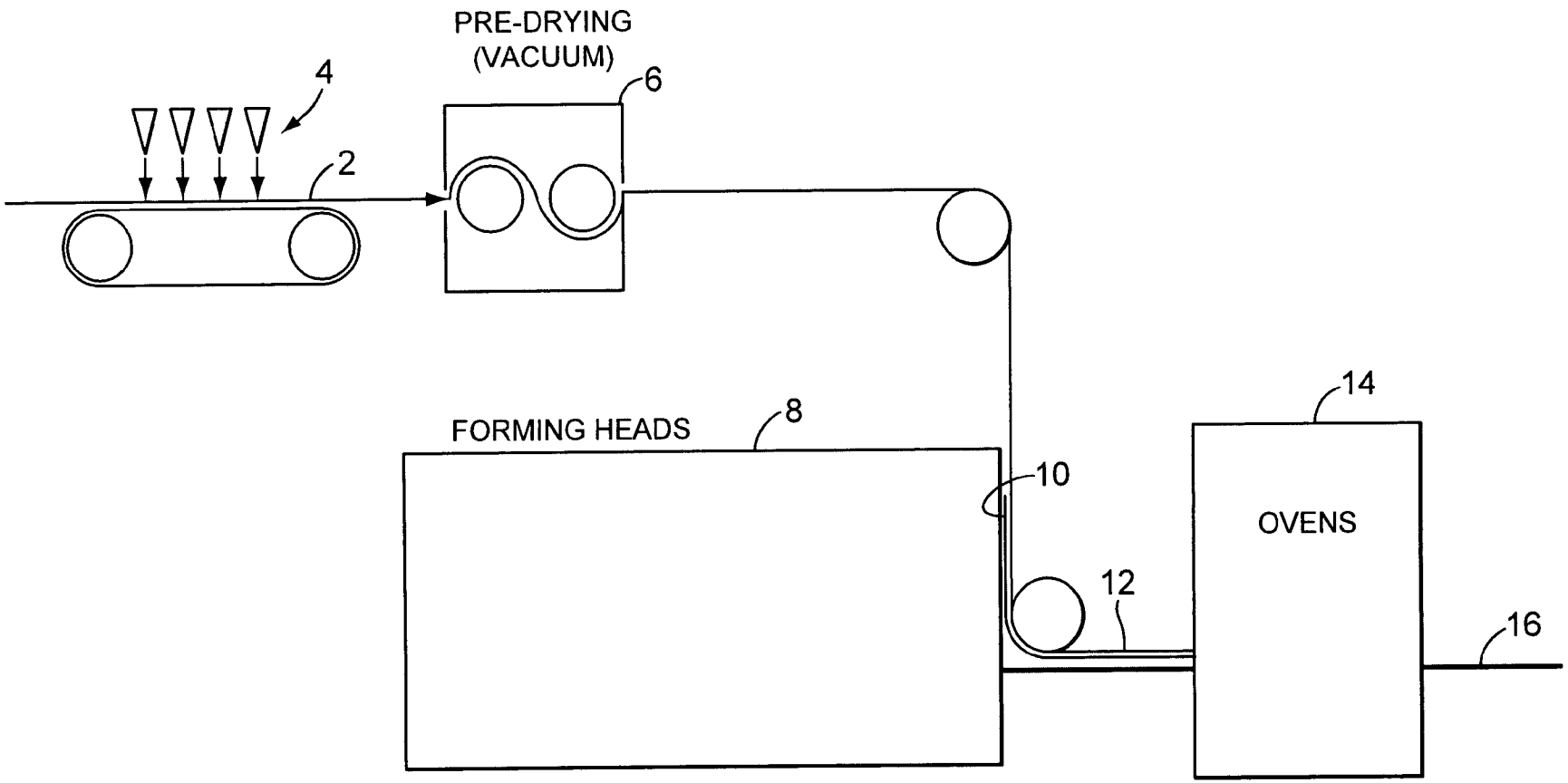

The present invention claims the priority of U.S. Provisional Application No. 60/157,689, filed Oct. 5, 1999.

FIELD OF THE INVENTION

The present invention relates to non-woven fabrics having high bulk. In particular, the present invention relates to composite non-woven fabrics having a high bulk layer attached to a non-woven substrate layer.

BACKGROUND OF THE INVENTION

The prior art contains examples of non-woven fabrics useful as wipes, towels, or other absorbent articles. These fabrics may combine a non-woven absorbent layer with a non-woven substrate layer for structure and strength. In one type of prior art non-woven absorbent, a high loft, low density layer is combined with a hydroentangled substrate web. The resulting fabric is desirable in that it offers the high loft and low density associated with the first layer in combination with the generally soft hand of the hydroentangled substrate layer, as is desirable, for example, when used as a baby wipe.

These prior art fabrics, however, have several unresolved problems associated with them. In particular, when attaching the high loft layer to the hydroentangled substrate non-woven layer, it has been difficult to maintain the first layer's high loft and bulk. In order to achieve its loft, the first layer is typically air laid. Methods for subsequently attaching the first layer to the substrate layer have generally included hydrostitching and hydroentangling. These methods, however, result in a wetting of the air laid high loft layer and a resultant permanent compression and densification thereof.

In addition to problems associated with composite fabrics having an air laid layer, problems also exist with prior art air laid non-woven layers in and of themselves. In particular, such fabrics have heretofore suffered from excessive dusting and linting.

Several unresolved problems therefore exist relating to non-woven fabrics having a high loft and high bulk component.

OBJECTS OF THE INVENTION

It is an object of the invention to provide a non-woven composite fabric having a non-woven substrate layer thermally bonded to a high loft absorbent layer.

It is a further object of the invention to provide a method for producing a composite non-woven fabric having a high loft absorbent layer and a non-woven substrate layer.

DESCRIPTION OF THE INVENTION

FIG. 1 illustrates a processing line for producing non-woven fabrics according to the present invention.

DESCRIPTION OF THE INVENTION

The method generally comprises the steps of providing a hydroentangled non-woven layer having a first binder component, and depositing a second non-woven layer having a high bulk and loft on to the hydroentangled layer to form an unbonded composite fabric. The second layer also has a binder component with a melting temperature substantially equal to the first binder melting temperature.

The unbonded composite is then thermally bonded with air heated to a temperature in the range of the melting points of the first and second binder fibers. The thermal bonding step may comprise air drying of the composite to remove moisture from the hydroentangled layer. Also, the bonding step may comprise heating in an oven. As they begin to melt, the binder fibers from each layer flow at least partially across the interface between the two layers. In this manner, the layers are simultaneously stabilized and the composite is bonded together without densifying any of the layers. Advantageously, bonding between layers thereby takes place without any wetting of the high bulk and loft layer, thereby preserving its loft and bulk qualities.

An embodiment of the method of the invention as described above is illustrated schematically in FIG. 1. A first web 2 is hydroentangled at hydroentangling station 4. Web 2 comprises at least a binder fiber portion. Web 2 may be hydrophobic or hydrophilic. Preferably, the first web layer 2 comprises staple rayon fibers hydroentangled together with binder fibers. The staple rayon fibers preferably comprise 60–85% by weight of the layer, and are between about 1.7–6 dtex and about 30–70 mm in length. Binder fibers preferably comprise between about 15–40% by weight of the layer. Prior to hydroentangling, a staple fiber batt may be prepared by any means as are known in the art, including, by way of example, carding, randomization, and air laying. The batt is then hydroentangled by any method as are generally known in the art. An example of a hydroentangling method is described in U.S. Pat. No. 3,485,706 to Evans, herein incorporated by reference. The hydroentangled web 2 has a preferred basis weight in the range of 10–100 gm/m$^2$, with 20–70 gm/m$^2$ most preferred.

Hydroentangled web 2 may then be pre-dried under vacuum in drier 6. This step of pre-drying is optional.

Forming heads 8 then deposit a high loft second web 10 on first web 2 to form unbonded composite 12. Preferred second layer 10 comprises 60–85% by weight pulp and 15–40% by weight binder fiber. The most preferred pulp is Southern Kraft, as is known in the art. Preferably, the second layer 10 is air laid substantially dry. An example of air laying is provided in U.S. Pat. No. 3,692,622 herein incorporated by reference. The second web has a preferred basis weight in the range of 10–100 gm/m$^2$, with 20–70 gm/m$^2$ most preferred. The second layer 10 may be deposited on either side of the hydroentangled first layer 2, and may be in the form of a prepared tissue sheet, as an airlaid mat applied directly to the staple web surface, or as an airlaid web provided on a forming wire. The two webs 2 and 10 are provided in a preferred weight ratio of about 1:1, with an operable ratio of between 1:4 to 4:1.

The binder fibers for both web layers 2 and 10 preferably comprise bicomponent fibers having polyethylene as the outer layer with one of either poly(ethylene terephalate) or polypropylene as the inner layer. Bicomponent fibers are preferred over homogenous fibers as bicomponent fibers will lose only part of their structure during melting, with the remaining member able to participate in the fabric structure and add resiliency. Sheath-core and side by side bicomponent fibers may be used. Binder fibers are preferably 30–70 mm in length, and 1.7–6 dtex. Most preferred binder fibers are 40–60 mm in length, 2.2 dtex, and comprise 20% by weight of the respective layer. Binder fiber components of both webs 2 and 10 have substantially equal melting temperatures, which are generally low and preferably in the range 129–134° C. for the polyethylene portion.

The two layers 2 and 10 of un-bonded composite web 12 are then bonded to one another by passage through ovens 14, which operate at a temperature in the range of the binder fiber melting temperatures. At least a portion of the binder components of the two layers melt in oven 14 and flow into the fiber crossover junctions of the individual webs and into the layer interface region. In this manner, the layers are simultaneously stabilized and bonded to one another without densifying either of the layers. Bonded composite fabric 16 results, which retains the high loft quality of web 10.

In a most preferred embodiment of the method of the invention, the pre-drier 6 of FIG. 1 is eliminated, and high loft web 10 is directly air laid dry onto wet hydroentangled web 2. Bonding of the unbond composite web then takes place simultaneously with drying of web 2 in oven 14, which may comprise a drier. By combining drying with bonding, this most preferred embodiment of the method of the thereby provides a significant manufacturing cost and time savings.

In an additional embodiment of the invention, a second hydroentangled web is provided on the exposed side of the high loft layer prior to the thermal bonding step. An unbonded composite is thereby formed with the two hydroentangled layers sandwiching the high loft layer. The second hydroentangled web is substantially the same as the first, with a binder component also as described in relation to the previously described binders. The unbonded composite is then thermally bonded with air heated to a temperature in the range of the binder fiber melting point. This results in the binder component of all three layers melting and flowing at least partially across the layer interfaces. In this manner, the layers are simultaneously stabilized and the composite is bonded together without densifying any of the layers. The resultant bonded composite fabric retains the high loft of the pulp layer, as well as having greatly reduced linting and dusting characteristics over the high loft fabric alone or in combination with a single hydroentangled layer.

In addition to the methods as described above, the present invention further comprises the non-woven fabric products produced thereby. The composite non-woven fabric of the invention generally comprises a hydroentangled first layer that comprises at least a binder fiber component, a high loft second layer that also has a binder fiber component, with the second high loft layer deposited on the first layer. The binder fiber component from the second layer extends at least partially across a layer interface and into the first layer, and the binder fiber component from the first layer likewise extends at least partially across a layer interface and into the second layer, with the two layers thereby bonded together. The layers are thus advantageously bonded without densifying of either layer.

Preferably, the first layer of the fabric of the invention comprises staple rayon fibers hydroentangled together with binder fibers. The staple rayon fibers preferably comprise 60–85% by weight of the layer, and are between about 1.2–6 dtex and about 30–70 mm in length. Binder fibers preferably comprise between about 15–40% by weight of the layer. Prior to hydroentangling, a staple fiber batt may be prepared by any means as known in the art including, by way of example, carding, randomization, and air laying. The batt is then hydroentangled by any methods as are generally known in the art. An example of a hydroentangling method is described in U.S. Pat. No. 3,485,706 to Evans, herein incorporated by reference. The hydroentangled web has a preferred basis weight in the range of 10–100 gm/m$^2$, with 20–70 gm/m$^2$ most preferred.

The preferred second layer of the fabric of the invention comprises 60–85% by weight pulp and 15–40% by weight binder fiber. A most preferred pulp is Southern Kraft, as is known in the art. Preferably, the second layer is substantially dry. The second web has a preferred basis weight in the range of 10–100 gm/m$^2$, with 20–70 gm/m$^2$ most preferred. The second layer may be deposited on either side of the hydroentangled first layer, and may be in the form of a prepared tissue sheet, as an airlaid mat applied directly to the staple web surface, or as an airlaid web provided on a forming wire. The two webs are present in a preferred weight ratio of about 1:1, with an operable ratio of between 1:4 to 4:1.

The binder fibers for both layers of the fabric of the invention preferably comprise bicomponent fibers with a polyethylene outer layer and one of either poly(ethylene terephalate) or polypropylene as an inner layer. Bicomponent fibers are preferred over homogenous fibers as bicomponent fibers will lose only part of their structure during melting, with the remaining member able to participate in the fabric structure and add resiliency. Sheath-core and side-by-side bicomponent fibers may be used. Binder fibers are preferably 30–70 mm in length, and 1.7–6 dtex; most preferably 40–60 mm in length, 2.2 dtex, and they comprise 20% by weight of the respective layer.

In an additional embodiment of the fabric of the invention, a second hydroentangled web is bonded to the exposed side of the high loft layer, with the high loft layer thereby sandwiched between the two hydroentangled layers. The second hydroentangled web is substantially the same as the first, with a binder component also as described in relation to the previously described binders. The binder fiber component extends at least partially over a layer interface and into the high loft layer to thereby bond the two layers together. In this manner, the three layers are simultaneously stabilized and the composite is bonded together without densifying any of the layers. The resultant bonded composite fabric retains the high loft of the pulp layer, and shows greatly reduced linting and dusting characteristics over the high loft fabric alone or in combination with a single hydroentangled layer. Such a fabric my prove particularly useful as a baby wipe.

It is to be understood that the disclosure is not limited in its application to the details of the construction and the arrangements set forth in the following description or illustrated in the drawing. The present invention is capable of other embodiments and of being practiced and carried out in various ways, as will be appreciated by those skilled in the art. Also, it is to be understood that the phraseology and terminology employed herein are for description and not limitation.

What is claimed is:

1. A method for preparing a composite non-woven fabric comprising the steps of:

a) providing a first non-woven hydroentangled substrate web layer containing moisture and having predominantly staple length fibers, and a lesser weight percentage of a first binder fiber component, said first binder fibers having a desired melting temperature range;

b) depositing a substantially dry second non-woven layer on said first layer to form an unbonded composite, said second layer predominantly having a high bulk, high loft pulp fiber component and a lesser weight percentage of a second binder fiber component, said second binder fibers having a desired melting temperature range substantially equal to said first binder fiber component melting temperature;

c) thermally bonding with a heated gaseous medium said unbonded composite, said gaseous medium heated to a temperature in the range of said first and second binder fiber melting temperature; said first and second binder fiber components at least partially melting and flowing into an interface region between said first and second layers; and cooling said layers; said layers thereby being stabilized and bonded together without increasing the density of either layer, while removing moisture from said first layer; and d) further comprising the step of providing a third layer, said third layer comprised of hydroentangled staple fibers having a third fiber binder component having a melting temperature substantially equal to said first and second binder fibers, said second layer sandwiched between said first and third layers to form said unbonded composite, said unbonded composite being thermally bonded by heated air at a temperature in the range of said binder fiber melting point.

2. A method as in claim 1, wherein said first layer comprises 60–85% rayon staple length fibers, and 40–15% of a bicomponent binder fiber.

3. A method as in claim 2, wherein said bicomponent binder fiber comprises an outer layer of polyethylene and an inner layer chosen from the group consisting of poly(ethylene terephalate) and polypropylene; and wherein said bicomponent fiber is 30–70 mm in length, and 1.7–6 dtex.

4. A method as in claim 1, wherein said second layer comprises a mixture of 60–85% by weight pulp and 15–40% by weight of said second bicomponent binder fibers, and wherein said second bicomponent binder fiber comprises an outer layer of polyethylene and an inner layer chosen from the group consisting of poly(ethylene terephalate) and polypropylene; and wherein said bicomponent fiber is 30–70 mm in length, and 1.7–6 dtex.

5. A method as in claim 4, wherein said binder fiber has a length of 40–60 mm, and is about 2.2 dtex.

6. A method as in claim 4, wherein said pulp comprises Southern Kraft.

7. A method as in claim 1, wherein said second layer comprises substantially dry tissue.

8. A method as in claim 1, wherein said first and second layers each having a basis weight between about 10–100 $gm/m^2$.

9. A method as in claim 1, wherein said first and second layers each having a basis weight between about 20–70 $gm/m^2$.

10. A method of making a high loft non-woven fabric comprising the steps of:

a) hydroentangling a first web, comprised of a binder fiber component;

b) depositing a substantially dry air laid pulp layer on said hydroentangled web while said hydroentangled web is substantially wet to form an unbonded composite; said pulp layer having a binder fiber component; and c) simultaneously drying said hydroentangled web and bonding said unbonded composite by exposing said unbonded composite to heated air, said heated air at least partially melting said binder fiber, said binder fibers at least partially flowing across a pulp layer and web interface and thereby bonding said layer and said web together, further comprising the step of providing a third layer, said third layer comprised of hydroentangled staple fibers having a binder fiber component having a melting temperature equal to said previously-recited binder fiber components, said pulp layer being sandwiched between said first web and said pulp layer to form said unbonded composite, said unbonded composite being thermally bonded by heated air at a temperature in the range of said binder fiber melting point.

11. A method for preparing a composite non-woven fabric comprising the steps of:

a) providing a first, non-woven hydroentangled substrate web layer having a first binder fiber component, said first binder fibers having a desired melting temperature range;

b) depositing a second non-woven layer on said first layer to form an unbonded composite, said second layer having a high bulk, high loft fiber component and a second binder fiber component, said second binder fibers having a desired melting temperature range substantially equal to said first binder fiber component melting temperature;

c) thermally bonding with a heated gaseous medium said unbonded composite, said gaseous medium heated to a temperature in the range of said first and second binder fiber melting temperature; said first and second binder fiber components at least partially melting and flowing into an interface region between said first and second layers; and cooling said layers; said layers thereby stabilized and bonded together without increasing the density of either layer; and d) further comprising the step of providing a third layer, said third layer comprised of hydroentangled staple fibers having a third fiber binder component having a melting temperature substantially equal to said first and second binder fibers, said second layer sandwiched between said first and third layers to form said unbonded composite, said unbonded composite being thermally bonded by heated air at a temperature in the range of said binder fiber melting point.

* * * * *